US008534947B2

(12) United States Patent
Prax

(10) Patent No.: US 8,534,947 B2
(45) Date of Patent: Sep. 17, 2013

(54) DISPOSABLE FLUID APPLICATOR

(76) Inventor: Ralf Prax, Willoughby Hills, OH (US)

( * ) Notice: Subject to any disclaimer, the term of this patent is extended or adjusted under 35 U.S.C. 154(b) by 655 days.

(21) Appl. No.: 12/237,461

(22) Filed: Sep. 25, 2008

(65) Prior Publication Data

US 2010/0074671 A1 Mar. 25, 2010

(51) Int. Cl.
*B43K 5/14* (2006.01)

(52) U.S. Cl.
USPC ..... 401/133

(58) Field of Classification Search
USPC ..... 401/132–134, 7; 604/3
See application file for complete search history.

(56) References Cited

U.S. PATENT DOCUMENTS 4,959,881 A * 10/1990 Murray ..... 15/227
5,090,832 A * 2/1992 Rivera et al. ..... 401/132
6,547,468 B2 * 4/2003 Gruenbacher et al. ..... 401/133
7,604,623 B2 * 10/2009 Brunner et al. ..... 604/385.101
7,651,290 B2 * 1/2010 Bauer et al. ..... 401/133
2005/0201812 A1 * 9/2005 Wong et al. ..... 401/7
2007/0048063 A1 * 3/2007 Bauer et al. ..... 401/7

* cited by examiner

*Primary Examiner* — Huyen Le
(74) *Attorney, Agent, or Firm* — Christopher J. Vandam, PA; Chris Vandam

(57) ABSTRACT

A disposable fluid applicator having a reservoir with a first membrane and a second membrane. Said reservoir containing a fluid to be dispensed. Said first membrane of the reservoir having perforations and being covered by a permeable and/or absorbent spreader. A removable tab assembly is disposed between said spreader and said first membrane of the reservoir that seals said perforations. When the tab is pulled from between said spreader and said first membrane of the reservoir the perforations are unsealed allowing the fluid contained inside the reservoir to flow out through the perforations into and through the spreader where the fluid can be applied to a desired surface.

10 Claims, 3 Drawing Sheets

DISPOSABLE FLUID APPLICATOR

BACKGROUND OF THE INVENTION

1. Field of the Invention

The present invention relates to fluid applicators, and more particularly, to a disposable fluid applicator that contains fluid and selectively dispenses said fluid.

2. Description of the Related Art

Several designs for fluid applicators have been designed in the past. None of them, however, includes a fluid reservoir that may be easily and safely opened without applying pressure to a frangible seal combined with a spreader and in a disposable format.

Applicant believes that the closest reference corresponds to U.S. Pat. No. 6,547,468 issued to Gruenbacher et. al. However, it differs from the present invention because the Gruenbacher device employs a frangible seal to open a reservoir and requires pressure to rupture the seal before use. When a user applies pressure to rupture the frangible seal and thus open said reservoir the rupture tends to be uncontrollable and creates the likelihood that more of the contents of the reservoir are dispensed when applying pressure to break the seal than desired. Similarly, because the reservoir seal is frangible the device must be protected from pressure before the device is used or the risk of unintended rupturing of the frangible seal remains.

Kerch et. al. discloses in U.S. Pat. No. 4,762,124 a liquid dispensing pouch that does not include a reservoir to contain the liquid being dispensed and therefore is limited in the amount of liquid that can be dispensed by the device to how much liquid can be absorbed in the absorbent layer. Furthermore, the Kerch design will not likely allow all of the fluid contained in the absorbent layer to be fully dispensed because some of the fluid will remain in the absorbent layer thereby reducing its efficiency.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that efficiently and safely dispenses fluid in a controlled manner.

It is another object of this invention to provide a device that is environmentally responsible yet is disposable.

It is still another object of the present invention to provide a device that avoids overspray, is hygienic, provides even coverage of the dispensed fluid, is easy to transport and is durable for storage and transport.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

The present device is a disposable fluid applicator. The device is ideally suited for the application of fluids onto the human body, for example, lotion, cream, sunscreen, insect repellant, moisturizer, sanitizer, soap, beauty treatment, colorant or any other desirable foam, emulsion, gel, cream or fluid. The device is equally suited to dispense fluid for other applications, for example, polish, sanitizer, cleaner, cleanser, wood stain, automotive treatment or any other desirable gel, cream, chemical or other fluid.

Figure 1:
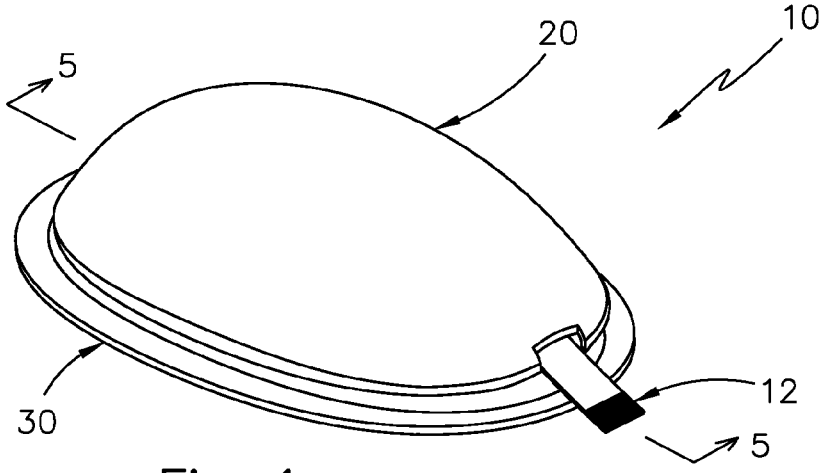
FIG. 1 represents a perspective view of an embodiment of the disposable fluid applicator.

Referring now to the drawings, where in FIG. 1 the present invention is generally referred to with numeral 10 (sometimes referred to as "the device"), it can be observed that it basically includes a tab assembly 12, a applicator assembly 20 and a reservoir assembly 30.

Figure 2:
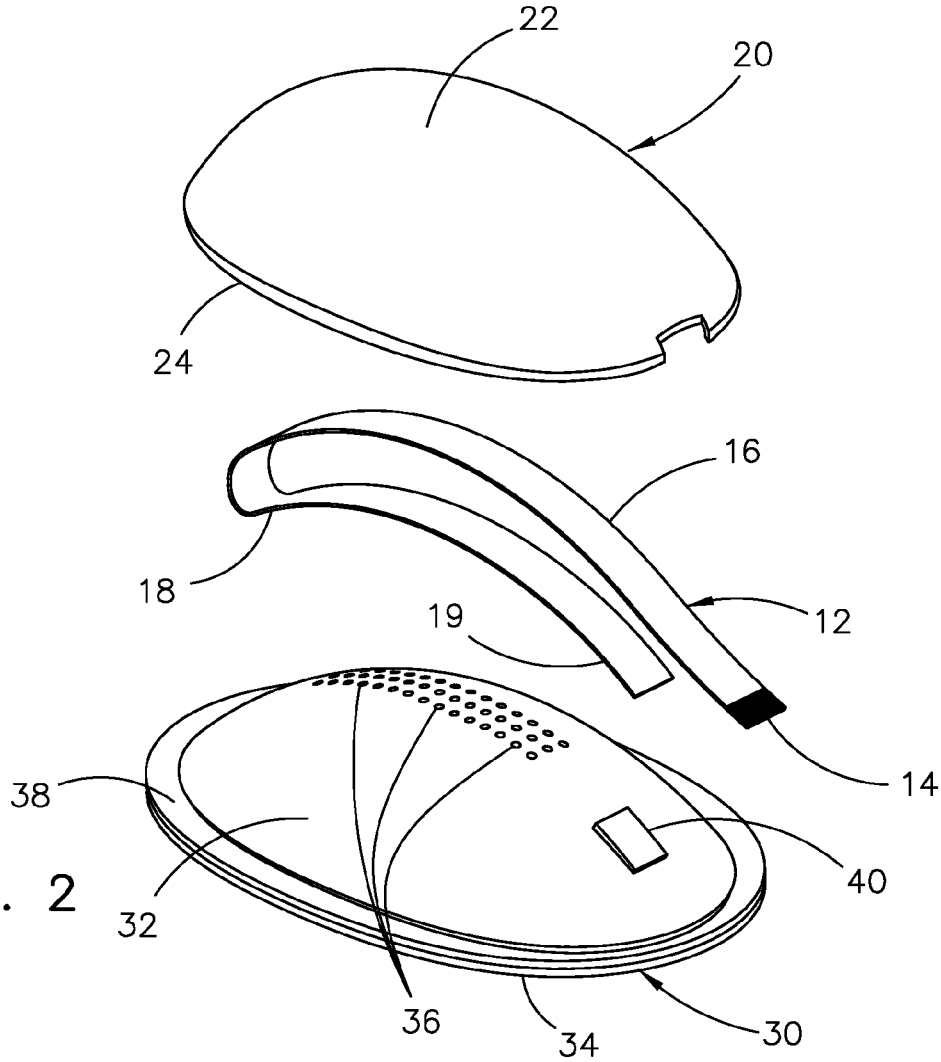
FIG. 2 shows an exploded perspective view of an embodiment of the disposable fluid applicator.

Now referring to FIG. 2 where an exploded view of the invention is shown. It can be seen that the tab assembly 12 is further comprised of a grip 14 and a tape 16. Said tape 16 having, inter alia, a surface 18 and a surface 19. Said applicator assembly 20 is shown to be comprised of, inter alia, a spreader 22 and an edge 24. said reservoir assembly 30 is shown to be comprised of, inter alia, a membrane 32, a membrane 34, perforations 36, a seam 38 and a seal 40.

In the embodiment shown in FIG. 2 said spreader 22 may be comprised of any of commonly used materials that is permeable by a fluid contained inside of the reservoir assembly. For many applications this could include a fibrous material, a porous synthetic or natural material, sponge, woven or knitted fabric, bristles or any other material known in the art to permit a fluid contained inside the reservoir assembly 30 to flow through the applicator assembly 20 so it can be spread on a surface with the applicator 22. For example, if the fluid to be dispensed is sunscreen a non-woven fibrous material would be one of several suitable choices of material for the spreader 22. In another example, if the fluid dispensed is to be a cleaning fluid, bristles may be one of several suitable selections for the spreader 22.

Still referring to FIG. 2, said reservoir assembly 30 is formed from said membrane 32 on a first side and said membrane 34 on a second side. Membrane 32 and membrane 34 are joined together around the periphery of membrane 32 and membrane 34 at said seam 38 to form a generally hollow interior reservoir that contains a fluid to be dispensed. Said seam 38 may be formed by means of welding, adhesive, stitching, crimping or any other means commonly known in the art to create a leak-resistant seal between membrane 32 and membrane 34.

In the embodiment demonstrated in FIG. 2 said membrane 32 and said membrane 34 are both formed of a flexible and impermeable material, such as a synthetic polymer, foil, natural material or any suitable flexible and impermeable material known in the art. In an alternate embodiment, the membrane 34 may be made of a rigid or semi-rigid impermeable material. In any embodiment it is preferred to have at least either of membrane 32 or membrane 34 constructed of a flexible material to aid in the dispensation of a fluid contained in the reservoir assembly 30 by applying squeezing pressure by a users hand onto membrane 32 and membrane 34.

Yet referring to FIG. 2, a multiplicity of perforations 36 are positioned on and penetrate through membrane 32. Said perforations 36 are the conduit by which a fluid contained inside the reservoir assembly 30 exits the reservoir assembly 30 and passes into the applicator assembly 20. The diameter of the perforations 36 are dimensioned to compliment the viscosity of fluid being dispensed by the device. For thicker fluids the perforations 36 are typically dimensioned larger than if a lower viscosity fluid was being dispensed by the device.

Similarly the quantity of perforations 36 may vary depending on the viscosity of the fluid dispensed as well as how quickly the fluid should be dispensed. For example, if the device is used for polishing furniture the reservoir assembly is filled with furniture polish with a relatively low viscosity and the invention is to be used on multiple pieces of furniture then the diameter of the perforations 36 and the quantity of the perforations 36 would both be reduced than if used with a higher viscosity fluid and/or a more rapid dispensation time period. Typically between one and one hundred perforations 36 that are between 0.5 mm and 25 mm are present on the membrane 32. As would be appreciated by a practitioner of normal skill in the art, the quantity and diameter of the perforations 36 may vary depending on, inter alia, the viscosity of the fluid dispensed and for which type of application the disposable fluid dispenser 10 is being used.

The disposable fluid dispenser 10 is in a storage mode when all present perforations 36 are covered and sealed by said tab assembly 12. Said surface 18 of the tab assembly 12, in one embodiment, is coated with a pressure sensitive adhesive that is permanently adhered to said surface 18 and is removably adhered to the surface of membrane 32 that faces said applicator assembly 20 effectively temporarily sealing all of said perforations 36. The position of said perforations 36 are complimentary to the dimensions of said surface 18 of the tab assembly 12 to ensure that surface 18 covers each of the perforations 36.

Figure 3:
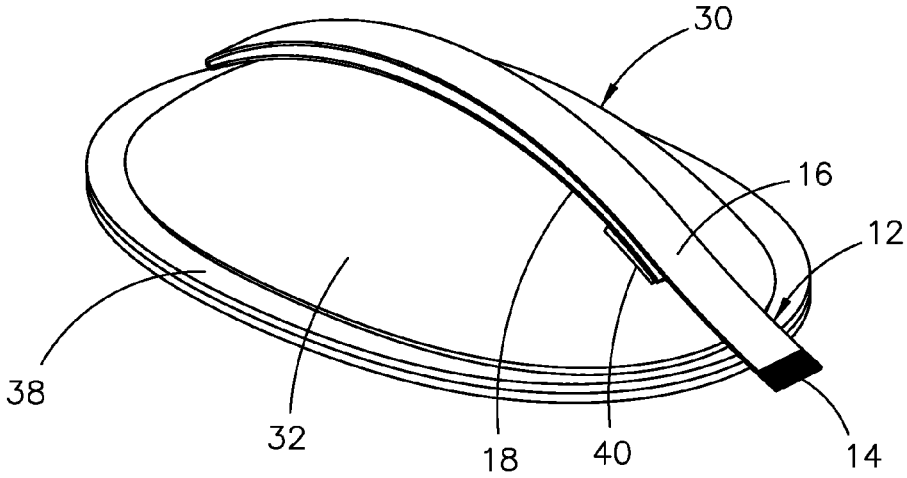
FIG. 3 illustrates a perspective view of an embodiment of the disposable fluid applicator without the applicator assembly where the tab assembly is not removed from the reservoir assembly.
Figure 4:
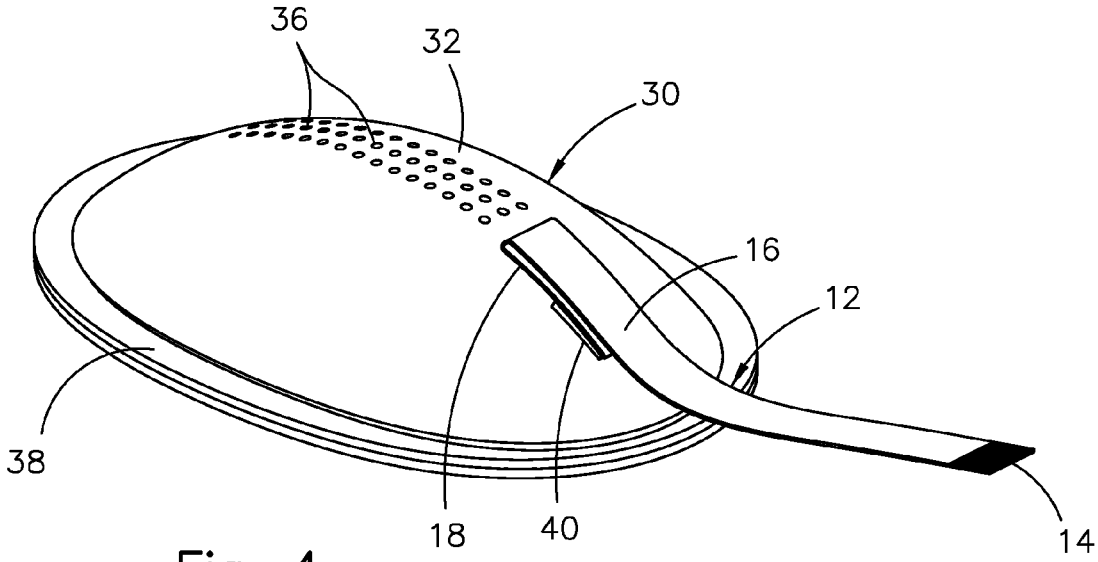
FIG. 4 is a representation of a perspective view of an embodiment of the disposable fluid applicator without the applicator assembly where the tab assembly is partially removed from the reservoir assembly.

Now referring in FIGS. 3 & 4 where for better understanding of the device 10 the applicator assembly 20 is not shown. For the embodiment shown in FIG. 1 the device 10 functions better for most applications to have the applicator assembly 20 permanently affixed to the membrane 32 around the periphery of the edge 24 of the applicator assembly 20 except where the tab assembly 12 protrudes from the seam between the applicator assembly 20 and the reservoir assembly 30. It is contemplated that for some uses of the device 10 that the applicator assembly 20 is not necessary for the functionality of the device.

Shown in FIG. 3 is the storage mode of the device 10 where the tab assembly 12 fully covers said perforations 36 with surface 18 removably adhered to membrane 32. FIG. 4 demonstrates the position of the tab assembly 12 partially removed from the membrane 32 thereby unsealing the perforations 36. When the tab assembly 20 is removed from the device 10 by a user and the perforations 36 are unsealed the fluid contained inside the reservoir assembly 30 is able to exit the reservoir assembly 30 through the perforations 36 and into the spreader 22 of the applicator assembly 20 where the fluid can be spread onto a desired surface. In at least one embodiment the spreader 22 is both porous and absorbent so that as the dispensed fluid is expelled the fluid is less likely to drip or otherwise deliver the fluid to an undesired surface due to the absorbent characteristics of the spreader 22.

Still referring to FIG. 4, seal 40 on a first side is permanently affixed to membrane 32. Seal 40 on its second side has an adhesive surface that is removably adhered to surface 18 of the tab assembly 12 when the device is in storage mode. When the grip 14 of the tab assembly 12 is pulled out and removed from between the applicator assembly 30 (not shown in FIG. 4) and the reservoir assembly 30 the second side of seal 40 is exposed to contact the applicator assembly 20 thereby completing the seal between the periphery of the applicator assembly 20 and the periphery of the reservoir assembly 32. Thus, as the device 10 is used and the fluid contained in the reservoir assembly 30 is expelled through the perforations 36 the fluid cannot escape through the gap between the applicator assembly 20 and the reservoir assembly 30 where the tab assembly 12 was after it is removed from the device 10. As disclosed above, the balance of the periphery of the spreader assembly 20 is permanently adhered to the reservoir assembly 30.

Figure 5:
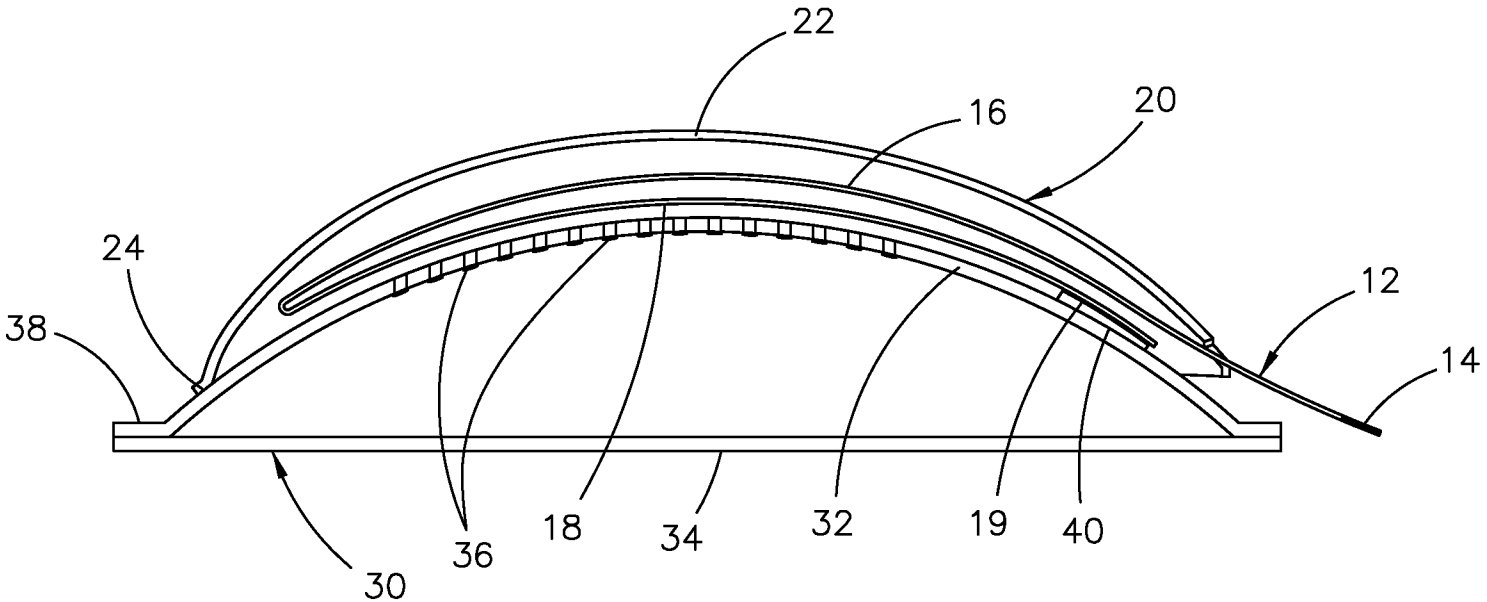
FIG. 5 is a cross section along cross section indicator lines shown in FIG. 1 demonstrating the various layers of the several assemblies comprising the device.

Referring now to FIG. 5 where a cross section elevation of FIG. 1 is shown. The tab assembly 12 is disposed between the applicator assembly and membrane 32 of the reservoir assembly 30. The fluid to be dispensed by the device 10 is contained between membrane 32 and membrane 34. When the tab assembly 12 is removed from between the applicator assembly 20 and the reservoir assembly 30 said fluid can exit the reservoir assembly 30 through the perforations 36 and flow into the spreader 22 of the applicator assembly 20 where the fluid can be applied to a target surface.

Also shown in FIG. 5 is seal 40 permanently affixed to membrane 32. A surface 19 on the tab assembly 12 is removably affixed to the seal 40. When the device 10 is prepared for use the tab assembly 12 is removed from between the applicator assembly 20 and the membrane 32 thus allowing the seal 19 to be in contact with and affix itself to the applicator assembly 20 and complete the connection between the applicator assembly 20 and the membrane 32 and allowing the only egress for the fluid contained inside the reservoir assembly 30 to be through the perforations 36 in the membrane 32.

In but one of several contemplated uses of the device 10 sunscreen lotion is fills the reservoir formed between membrane 32 and membrane 34. With the tab assembly in place as shown in FIG. 5 the device 10 is crush-resistant and leak-resistant and therefore can be stored and transported without special care. When a user of the device is desirous of applying the sunscreen lotion she pulls on grip 14 to remove the tab assembly 12 from between the applicator assembly 20 and reservoir assembly 30 and unseals the perforations 36. The user then squeezes the reservoir assembly with their fingers allowing the suntan lotion to flow through the perforations 36 in the membrane 32, into and through the spreader 22 where the fluid can be applied to the user's skin.

It would be appreciated to one reasonably skilled in the art that the device 10 not be necessarily in a disk shape as demonstrated in FIG. 1. Alternatively the device could be rectangular, triangular, oblong or any other shape that may contribute aesthetically or functionally to the overall usefulness of the device.

For example, the device 10 may be optimally triangular if the device 10 is used to apply a coating to the inside of a corner on a surface that the device 10 is applying fluid upon to allow for more complete coverage of the fluid being dispensed.

In one embodiment of the present invention is disclosed a disposable fluid applicator comprising a tab assembly 12, an applicator assembly 20 and a reservoir assembly 30. Said reservoir assembly 30 having a reservoir formed by a first membrane 32 and a second membrane 34 sealed together around the periphery of said first membrane 32 and said second membrane 34. Said first membrane 32 having a plurality of perforations 36. Said second membrane 34 being impermeable. Said applicator assembly 20 being porous and/or absorbent and being affixed to said first membrane 32. Said applicator assembly 20 covering said perforations. Said tab assembly 12 being disposed between said first membrane 32 and said applicator assembly 20. Said tab assembly 12 sealing said perforations 36 in said first membrane 32. Said tab assembly 12 being removable from between said first membrane 32 and said applicator assembly 20 thereby unsealing said perforations 36.

In another variation of the invention the disposable fluid applicator 10 is further characterized in that a seal 40 is affixed to said first membrane 32 that is adhearable to said applicator assembly 20 when said tab assembly 12 is removed that substantially completes a seal between the periphery of said first membrane 32 and the periphery of said applicator assembly 20.

In another variation of the invention the disposable fluid applicator is further characterized in that said applicator assembly 20 is formed of any one of a non-woven fibrous material, a fabric material, a sponge material or a porous synthetic material.

In another example, a more oval shape may be more aesthetically pleasing. Other shapes or various configurations may be suited to any of a variety of applications where a particular form may have advantages over the basic circular or oval shape shown in the drawings.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A disposable fluid applicator consisting of a tab assembly, an applicator assembly and a reservoir assembly;

Said reservoir assembly having a reservoir formed by a first membrane and a second membrane sealed together around the periphery of said first membrane and said second membrane;

Said reservoir containing a fluid to be dispensed;

Said first membrane having a central zone having a plurality of perforations;

Said second membrane being impermeable;

Said applicator assembly being porous and being affixed to said first membrane around a periphery of said applicator assembly;

Said applicator assembly covering said perforations;

Said tab assembly being disposed between said first membrane and said applicator assembly;

Said tab assembly sealing said perforations in said first membrane;

Said tab assembly being removable from between said first membrane and said applicator assembly, fully separating from the fluid applicator, thereby unsealing said perforations and allowing said fluid to dispense into and through said applicator assembly.

2. A disposable fluid applicator as described in claim 1 further characterized in that a seal is affixed to said first membrane that is adhearable to said applicator assembly when said tab assembly is removed that substantially completes a seal between the periphery of said first membrane and the periphery of said applicator assembly.

3. A disposable fluid applicator as described in claim 1 further characterized in that said applicator assembly is formed of any one of a non-woven fibrous material, a fabric material, a sponge material or a porous synthetic material.

4. A disposable fluid applicator consisting of a tab assembly, an applicator assembly and a reservoir assembly;

Said reservoir assembly having a reservoir formed by a first membrane and a second membrane sealed together around the periphery of said first membrane and said second membrane;

Said reservoir containing a fluid to be dispensed;

Said first membrane having a central zone having a plurality of perforations;

Said second membrane being impermeable;

Said applicator assembly being absorbent and being affixed to said first membrane around a periphery of said applicator assembly;

Said applicator assembly covering said perforations;

Said tab assembly being disposed between said first membrane and said applicator assembly;

Said tab assembly sealing said perforations in said first membrane;

Said tab assembly being removable from between said first membrane and said applicator assembly, fully separating from the fluid applicator, thereby unsealing said perforations and allowing said fluid to dispense into and through said applicator assembly.

5. A disposable fluid applicator as described in claim 4 further characterized in that a seal is affixed to said first membrane that is adhearable to said applicator assembly when said tab assembly is removed that substantially completes a seal between the periphery of said first membrane and the periphery of said applicator assembly.

6. A disposable fluid applicator as described in claim 4 further characterized in that said applicator assembly is formed of any one of a non-woven fibrous material, a fabric material, a sponge material or a porous synthetic material.

7. A disposable fluid applicator comprising a tab assembly, an applicator assembly and a reservoir assembly;

Said reservoir assembly having a reservoir formed by a first membrane and a second membrane sealed together around the periphery of said first membrane and said second membrane;

Said reservoir containing a fluid to be dispensed;

Said first membrane having a central zone having a plurality of perforations;

Said second membrane being impermeable;

Said applicator assembly being porous and being affixed to said first membrane around a periphery of said applicator assembly;

Said applicator is substantially equal in size to the reservoir;

Said applicator assembly covering said perforations;

Said tab assembly being disposed between said first membrane and said applicator assembly;

Said tab assembly sealing said perforations in said first membrane;

Said tab assembly being removable from between said first membrane and said applicator assembly, fully separating from the fluid applicator, thereby unsealing said perforations and allowing said fluid to dispense into and through said applicator assembly;

a seal is affixed to said first membrane that is adhearable to said applicator assembly when said tab assembly is removed that substantially completes a seal between the periphery of said first membrane and the periphery of said applicator assembly.

8. A disposable fluid applicator as described in claim 7 further characterized in that said applicator assembly is formed of any one of a non-woven fibrous material, a fabric material, a sponge material or a porous synthetic material.

9. A disposable fluid applicator comprising a tab assembly, an applicator assembly and a reservoir assembly;

Said reservoir assembly having a reservoir formed by a first membrane and a second membrane sealed together around the periphery of said first membrane and said second membrane;

Said reservoir containing a fluid to be dispensed;

Said first membrane having a central zone having a plurality of perforations;

Said second membrane being impermeable;

Said applicator assembly being absorbent and being affixed to said first membrane around a periphery of said applicator assembly;

Said applicator assembly covering said perforations;

Said applicator is substantially equal in size to the reservoir;

Said tab assembly being disposed between said first membrane and said applicator assembly;

Said tab assembly sealing said perforations in said first membrane;

Said tab assembly being removable from between said first membrane and said applicator assembly, fully separating from the fluid applicator, thereby unsealing said perforations and allowing said fluid to dispense into and through said applicator assembly;

a seal is affixed to said first membrane that is adhearable to said applicator assembly when said tab assembly is removed that substantially completes a seal between the periphery of said first membrane and the periphery of said applicator assembly.

10. A disposable fluid applicator as described in claim 9 further characterized in that said applicator assembly is formed of any one of a non-woven fibrous material, a fabric material, a sponge material or a porous synthetic material.

* * * * *